US009875597B2

(12) United States Patent
Warkentin

(10) Patent No.: US 9,875,597 B2
(45) Date of Patent: Jan. 23, 2018

(54) PROCESSING USER INFORMATION IN WAGERING GAME SYSTEMS

(75) Inventor: Terry D. Warkentin, Carson City, NV (US)

(73) Assignee: BALLY GAMING, INC., Las Vegas, NV (US)

( * ) Notice: Subject to any disclaimer, the term of this patent is extended or adjusted under 35 U.S.C. 154(b) by 861 days.

(21) Appl. No.: 12/443,483

(22) PCT Filed: Sep. 28, 2007

(86) PCT No.: PCT/US2007/079814

§ 371 (c)(1),
(2), (4) Date: Mar. 29, 2009

(87) PCT Pub. No.: WO2008/042736

PCT Pub. Date: Apr. 10, 2008

(65) Prior Publication Data

US 2010/0048291 A1 Feb. 25, 2010

Related U.S. Application Data

(60) Provisional application No. 60/848,555, filed on Sep. 29, 2006.

(51) Int. Cl.
*A63F 9/24* (2006.01)
*G07F 17/32* (2006.01)

(52) U.S. Cl.
CPC ..... *G07F 17/3206* (2013.01); *G07F 17/32* (2013.01); *G07F 17/3225* (2013.01); *G07F 17/3241* (2013.01)

(58) Field of Classification Search
CPC ..... G07F 17/3206; G07F 17/3241; G07F 17/3225

(Continued)

(56) References Cited

U.S. PATENT DOCUMENTS 5,397,886 A 3/1995 Mos et al.
5,694,323 A 12/1997 Koropitzer et al.
(Continued)

FOREIGN PATENT DOCUMENTS

WO WO-2005029220 3/2005

OTHER PUBLICATIONS

"International Application No. PCT/US2007/079814 International Search Report", Apr. 11, 2008 , 9 pages.
(Continued)

*Primary Examiner* — David L Lewis
*Assistant Examiner* — Robert Mosser
(74) *Attorney, Agent, or Firm* — DeLizio Law, PLLC

(57) ABSTRACT

Techniques for processing user information in wagering game systems are described herein. In some embodiments, a system includes a first wagering game system to assign a first set of access credentials to a user, wherein the first wagering system is connected to a first set of wagering game machines. The system can also include a second wagering game system to assign a second set of access credentials to the user, wherein the second wagering system connected to a second set of wagering game machines. The systems can also include a master identifier controller to receive and store the first and second sets of access credentials, to receive requests to access the first wagering game system based on the second set of user access credentials, and to facilitate access the first wagering game system based on the second set of user access credentials.

18 Claims, 11 Drawing Sheets

(58) Field of Classification Search
USPC ..... 463/1, 25, 29, 42
See application file for complete search history.

(56) References Cited

U.S. PATENT DOCUMENTS

| | | | |
|---|---|---|---|
| 8,096,875 | B2 | 1/2012 | Ryan |
| 2003/0004871 | A1 | 1/2003 | Rowe |
| 2003/0130042 | A1 | 7/2003 | Ollins |
| 2005/0003890 | A1 | 1/2005 | Hedrick et al. |
| 2005/0054438 | A1 | 3/2005 | Rothschild et al. |
| 2005/0096130 | A1 | 5/2005 | Mullins |
| 2005/0288085 | A1 | 12/2005 | Schubert et al. |
| 2006/0183538 | A1 | 8/2006 | Michaelson et al. |
| 2007/0026943 | A1 | 2/2007 | Yoshimura |
| 2007/0060332 | A1 | 3/2007 | Anderson et al. |
| 2007/0060381 | A1 | 3/2007 | Weiss |
| 2007/0117623 | A1 | 5/2007 | Nelson et al. |
| 2007/0213132 | A1 | 9/2007 | Chilton et al. |
| 2008/0051193 | A1 | 2/2008 | Kaminkow et al. |
| 2008/0051195 | A1 | 2/2008 | Hedrick et al. |

OTHER PUBLICATIONS

"PCT Application No. PCT/US2007/079814 International Preliminary Report on Patentability", Jan. 2, 2009 , 13 pages.
"International Application No. PCT/US2007/009656 International Search Report", dated Sep. 16, 2008, 8 pages.

| MASTER ID & AUTH INFO | MFGR SYS ID & AUTH INFO | JONES ID & AUTH INFO | ACME ID & AUTH INFO | BIG FUN ID & AUTH INFO | USER INFO | USER PRIV |
|---|---|---|---|---|---|---|
| JOHN_DOE XYZ345 | JOHND HOME252 | JOHND JONESYS200 | BKJKACE HOME252 | JOHND HOME252 | 408-222-2222 | FULL ACCESS |
| JANE_DOE KDHG338 | JANIE_D CARDS212 | JANE_DOE PASSWORD1 | | JANE_DOE PASSWORD1 | 916-222-2222 | FULL ACCESS |
| BIGPLAY1 839HGLKS | TOMJONES IMTOMJ22 | TOMJ IMTOMJ22 | TOMJ IMTOMJ22 | | 940-222-2222 | FULL ACCESS |

PROCESSING USER INFORMATION IN WAGERING GAME SYSTEMS

RELATED APPLICATIONS

This application claims the priority benefit of U.S. Provisional Application Ser. No. 60/848,555 filed Sep. 29, 2006.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, WMS Gaming, Inc.

FIELD

Embodiments of the inventive subject matter relate generally to wagering game systems, and more particularly to techniques for processing user information in wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

A wagering game network is described. In some embodiments, the wagering game network is comprising: a first wagering game system configured to assign a first set of access credentials to a user, wherein the first wagering system is connected to a first set of wagering game machines each configured to conduct wagering games; a second wagering game system configured to assign a second set of access credentials to the user, wherein the second wagering system connected to a second set of wagering game machines each configured to conduct wagering games; a master identifier controller configured to receive and store the first and second sets of access credentials, to receive requests to access the first wagering game system based on the second set of user access credentials, and to facilitate access the first wagering game system based on the second set of user access credentials. In some embodiments, the first and second sets of access credentials include one or more selected from the group consisting of username, password, and biometric information. In some embodiments, wherein the user is selected from the group consisting of a wagering game player, a system administrator, and a wagering game machine technician. In some embodiments, the first and second wagering game systems track wagers made by the user. In some embodiments, the first and second wagering game systems track repairs made by the user. In some embodiments, the master identifier controller is further configured to receive requests to access the first wagering game system based on the first set of user access credentials, and to facilitate access the first wagering game system based on the first set of user access credentials. In some embodiments, the master identifier controller is configured to receive the requests to access the first wagering game system from ones of the first set of wagering game machines.

A machine-readable medium including instructions that are executable by a machine is described. In some embodiments, the instructions are comprising: instructions to receive user information associated with a user identifier; instructions to determine one of a plurality of managed wagering game systems associated with the user identifier; and instructions to transmit the user information to the one of the plurality of managed wagering game systems. In some embodiments, the user information includes permission information.

In some embodiments, the instructions are further comprising: instructions to store the user information in a database, wherein the user information is stored in association with the user identifier. In some embodiments, the user information includes one or more selected from the group consisting of username, password, telephone number, address, credit limit, game play preferences, and payment information. In some embodiments, transmission of the user information to the one or more of the plurality of managed wagering game systems is to facilitate presentation of wagering games on the one or more managed wagering game systems. In some embodiments, the user information being received from a wagering game machine, another of the plurality of managed wagering game systems, or a configuration computer. In some embodiments, the instructions further comprising: instructions to determine others of the plurality of managed wagering game systems associated with the user identifier; instructions to transmit the profile information to the others of the plurality of managed wagering game systems.

A wagering game system method is described. In some embodiments, the method is comprising: receiving a first identifier, wherein the first identifier was assigned by a first wagering game system; receiving a second identifier; selecting a second wagering game system based on the second identifier; determining a third identifier associated with the first identifier and with the second wagering game system; and transmitting the third identifier for use in accessing the second wagering game system. In some embodiments, the first identifier is received as a result of one or more actions selected from the group consisting of receiving a player card at a wagering game machine, receiving a user card at wagering game configuration terminal, receiving a password at a wagering game machine, receiving a password at a configuration terminal, receiving biometric information at a wagering game machine, and receiving biometric information a configuration terminal. In some embodiments, the second identifier indicates one or more of the group consisting of a manufacturer of a wagering game machine, an operator of a wagering game machine, and wagering game system membership information. In some embodiments, the transmitting of the managed identifier includes transmitting the managed identifier to a destination selected from the group consisting of the managed wagering game system and a wagering game machine. In some embodiments, the third identifier is associated with one or more of the group consisting of casino patrons, casino administrators, service technicians, wagering game administrators, and wagering game players. In some embodiments, the first wagering game system is selected from the group consisting of a manufacturer player tracking system, a casino player tracking system, and a casino configuration systems.

BRIEF DESCRIPTION OF THE FIGURES

The present invention is illustrated in the Figures of the accompanying drawings in which.

DESCRIPTION OF THE EMBODIMENTS

This description of the embodiments is divided into five sections. The first section provides an introduction to embodiments of the invention, while the second section describes example wagering game system architectures. The third section describes example operations performed by some embodiments and the fourth section describes wagering game machines in more detail. The fifth section presents some general comments.

Introduction

This section introduces some embodiments of the invention.

Figure 1:
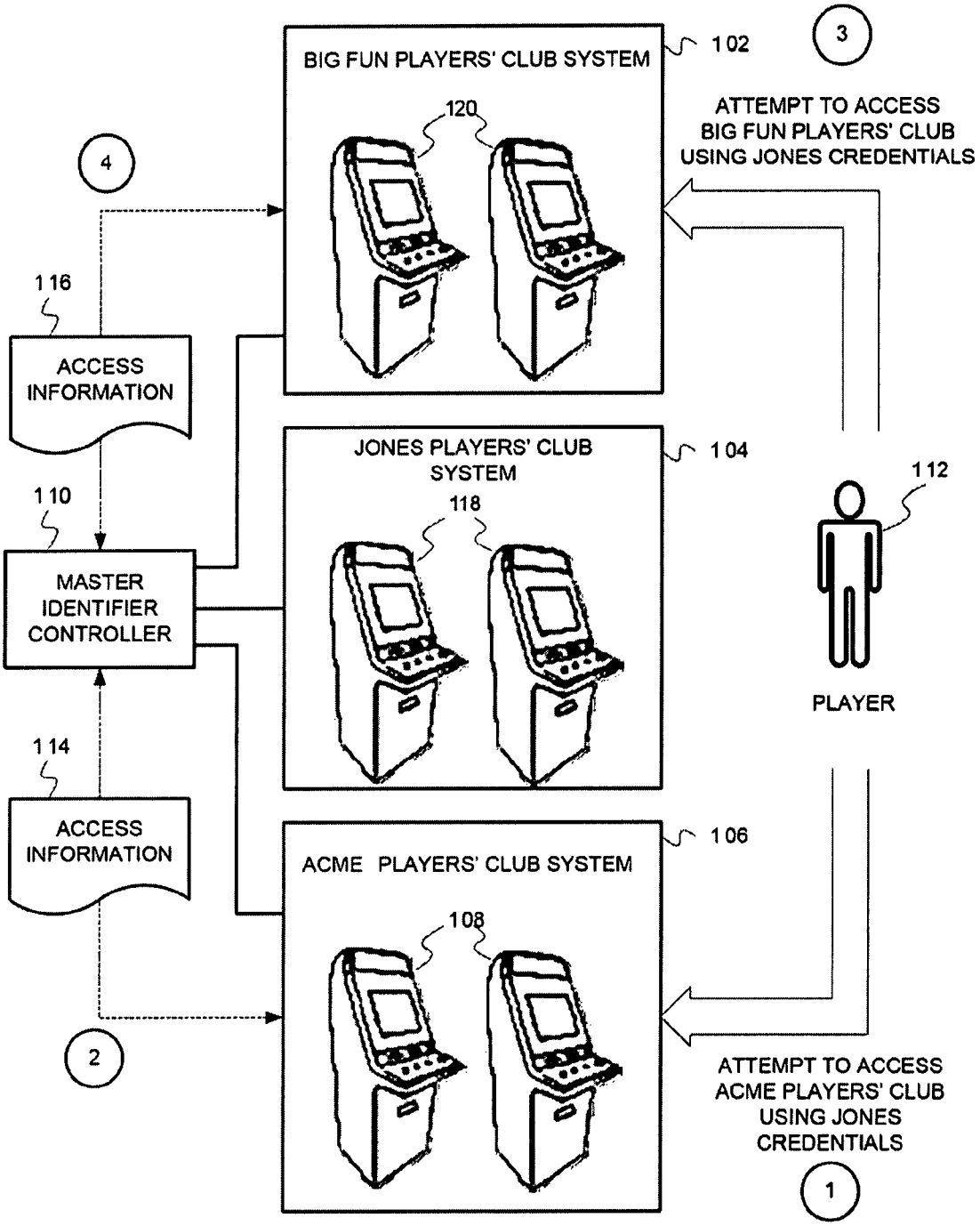
FIG. 1 is a dataflow diagram illustrating dataflow and operations for allowing players to access a plurality of separate wagering game systems using a single set of access credentials, according to example embodiments of the invention.

Players, system technicians, and others commonly use many different wagering game systems. Typically, each different wagering game system has its own access control logic that issues access credentials (e.g., usernames and passwords) and grants access based on those credentials. As a result, users who access many different wagering game systems often keep track of many different access credentials. However, some embodiments of the invention enable users to gain access to a plurality of different wagering game systems using credentials from any one of many wagering game systems or using a single set of "master credentials". FIG. 1 illustrates one such embodiment.

FIG. 1 is a dataflow diagram illustrating dataflow and operations for allowing players to access a plurality of separate wagering game systems using a single set of access credentials, according to example embodiments of the invention. In FIG. 1, a master identifier controller 110 is connected to three separate wagering game systems (i.e., Big Fun players' club system 102, Jones players' club system 104, and Acme players' club system 106). Although not shown, each of the systems 102, 104, and 106 has assigned the player 112 different access credentials (e.g., usernames and passwords). The master identifier controller 110 can store all access credentials assigned to the player 112 and it can create an association between the player 112 and all the different access credentials.

The dataflow and operations of FIG. 1 show how the player 112 can access any of the wagering game systems 102, 104, & 106 using access credentials associated with only one of the systems. During stage one, the player 112 provides the Acme system 106 with a username and password that were assigned by the Jones system 104. During stage two, the Acme system 106 passes the player's credentials, which were assigned by the Jones system 104, to the master identifier controller 110 (shown as access information 114). In turn, the master identifier controller 110 determines an association between the player's Jones credentials and those needed to access the Acme system 106. The controller 110 then sends a copy of the player's Acme credentials (shown as access information 114) to the Acme system 106, enabling the player to gain access to the Acme system 100. After gaining access, the player 112 can play the wagering game machines 108 and utilize other resources of the Acme players' club system 106.

Stages three and four are similar to stages one and two. During stages three and four, the player 112 uses the Jones credentials to gain access to yet another wagering game system—the Big Fun players' club system 102. Therefore, even though the player 112 received different access credentials for each of the wagering game systems (102, 104, and 106), the player needs only one set of access credentials to access any of the systems.

As alternative to the features described above, the master identifier controller 110 could assign the player 113 a set "master access credentials" (e.g., a name and password) that facilitate access to any system connected to the master identifier controller 110.

Although FIG. 1 describes some embodiments, the following sections describe many other features and embodiments of the invention.

Wagering Game System Architectures

This section presents example wagering game network and wagering game machine architectures.

Wagering Game Network Architecture

Figure 2:
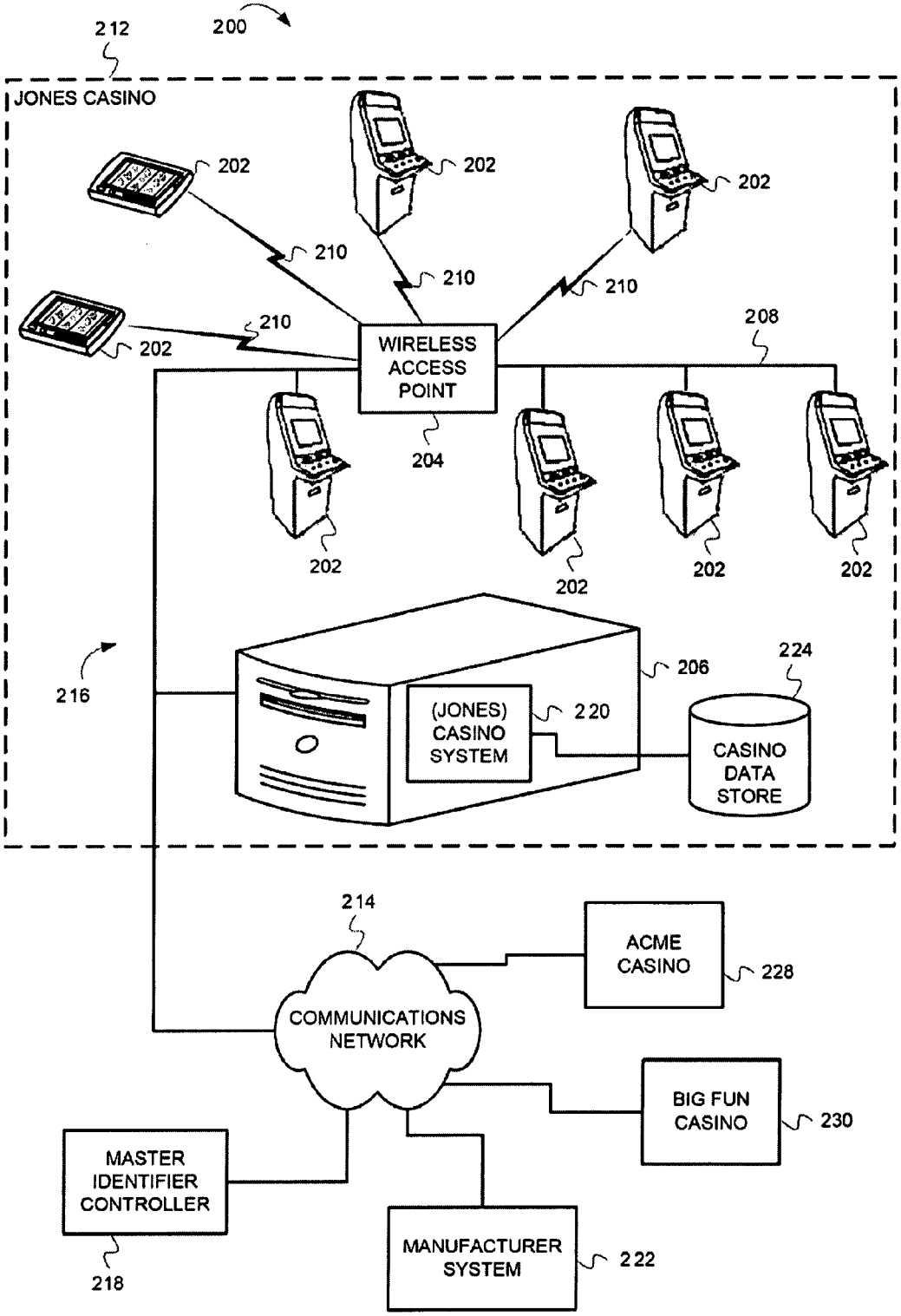
FIG. 2 is a block diagram illustrating a wagering game network architecture, according to example embodiments of the invention.

FIG. 2 is a block diagram illustrating a wagering game network architecture, according to example embodiments of the invention. As shown in FIG. 2, the wagering game network architecture 200 includes a communications network 214 connected to a plurality of casinos 212, 228, & 230, master identifier controller 218, and manufacturer system 222.

The Jones Casino 212 includes a local area network 216, which includes a wireless access point 204, wagering game machines 202, and a wagering game server 206, which is connected to a casino data store 224. The server 206 includes a casino system 220 which can include player tracking systems, players' club systems, etc. The wagering game server 206 can serve wagering games over the local area network 216 and the communications network 214. The casino system 220 can provide services to players and machine operators. Additionally, the casino system 220 can manage user credentials and control user access. The casino data store 224 can store the user credentials (e.g., usernames, passwords, biometric data, etc.) and other user information (e.g., name, address, telephone number, employee number, etc.).

The local area network 216 includes wireless communication links 210 and wired communication links 208. The wired and wireless communication links can employ any suitable connection technology, such as Bluetooth, 802.11, Ethernet, public switched telephone networks, SONET, etc.

The wagering game machines 202 described herein can take any suitable form, such as floor standing models, handheld mobile units, bartop models, workstation-type console models, etc. Further, the wagering game machines 202 can be primarily dedicated for use in conducting wagering games, or can include non-dedicated devices, such as mobile phones, personal digital assistants, personal computers, etc. In one embodiment, the wagering game network 200 can include other network devices, such as accounting servers, wide area progressive servers, player tracking servers, and/or other devices suitable for use in connection with embodiments of the invention.

Although not shown, the Acme Casino 228 and Big Fun Casino 230 can include the same components as the Jones Casino 212.

The master identifier controller 218 can facilitate access to systems with which it can communicate (e.g. over the communications network 214). The controller can also store user information associated with each casino system's users and it can create associations between user information from different casino systems. Additionally, the master identifier controller 218 can control data exchanges between systems of the wagering game network. For example, when a user of the Jones casino system 220 changes a mailing address, the master identifier controller 218 can store the new address and/or update other systems (e.g., the manufacturer system 222). These and other embodiments of a master identifier controller will be described in more detail below.

The manufacturer system 222 is another system that can provide services to players and administrators. For example, the manufacturer system 222 can reward players for playing wagering game machines produced by a certain manufacturer and it can assist technicians in servicing wagering game machines made by a certain manufacturer.

Any of the components shown in FIG. 2 can include hardware and machine-readable media including instructions for performing the operations described herein. Furthermore, the master identifier controller 218 can be included in the casino systems, the manufacturer system 222, or any other component of the architecture 200.

The section continues with a more detailed discussion about embodiments of the master identifier controller.

Figure 3:
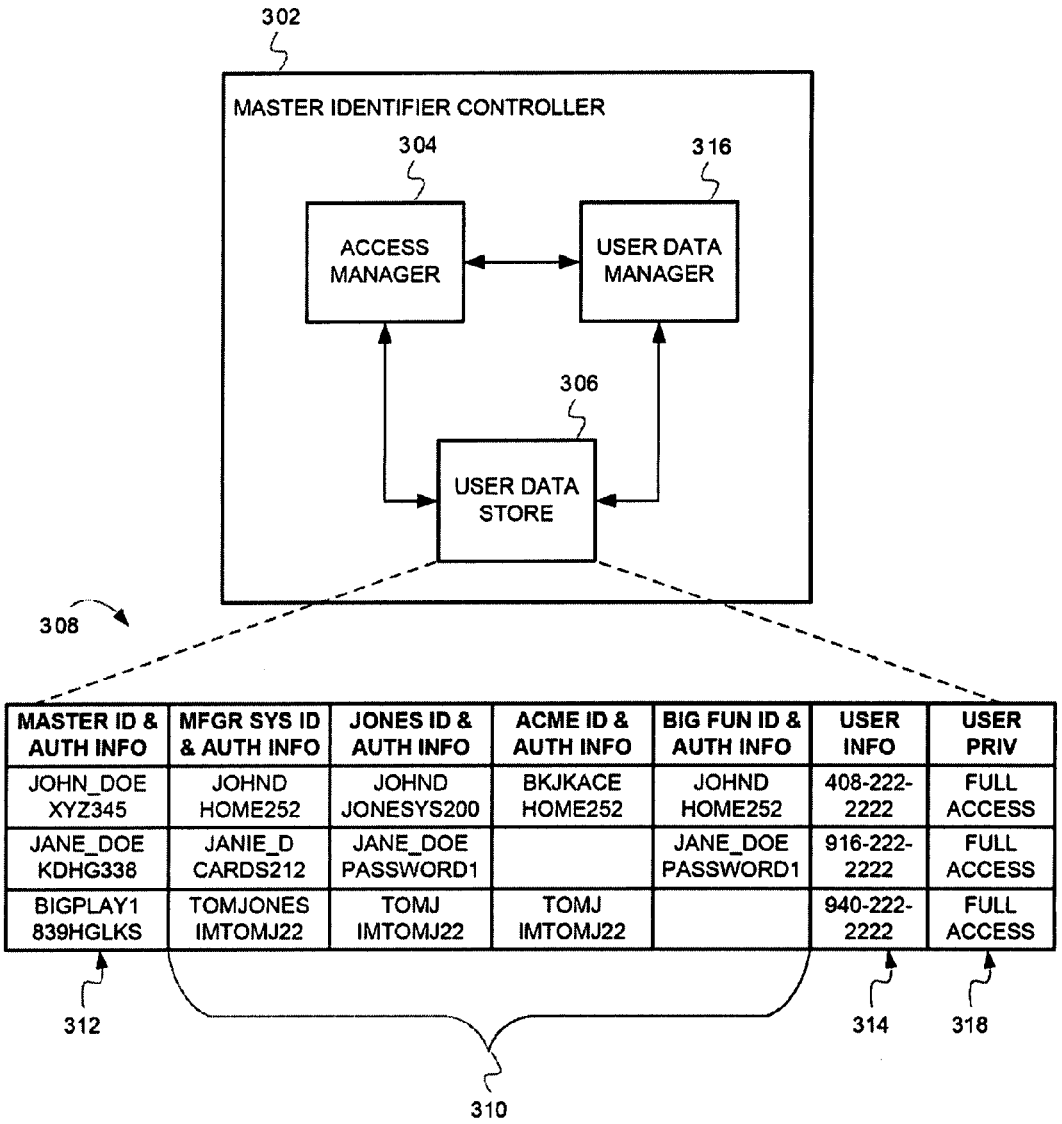
FIG. 3 is a block diagram illustrating a master identifier controller, according to example embodiments of the invention.

FIG. 3 is a block diagram illustrating a master identifier controller, according to example embodiments of the invention. In FIG. 3, the master identifier controller 302 includes an access manager 304, user data store 306, and user data manager 316. All three components are communicatively connected to each other, as shown in FIG. 3. The access manager 304 can use data in the user data store 306 to facilitate access to wagering game systems, while the user data manager 316 can modify data in the user data store 306.

The user data store 306 includes a database 308 including fields 312 for storing master identifiers and master authentication information, fields 310 for storing managed identifiers and managed authentication information, fields 314 for storing other user information, and fields 318 for storing user privileges. In some embodiments, the database 308 is organized differently than what is shown in FIG. 3. For example, the database 308 can include a plurality of tables.

The master and managed identifiers can include usernames or other identifying indicia, whereas the master and managed authentication information can include passwords, biometric information, or other information suitable for authenticating wagering game system users. In some embodiments, for each user, the identifiers and authentication information are merged into one set of information, such as biometric fingerprint information. Also, the user information fields 314 can include any suitable user information, such as a telephone number, address, jackpot winnings to date, employee number, salary, benefit package, etc.

Wagering Game Machine Architecture

Figure 4:
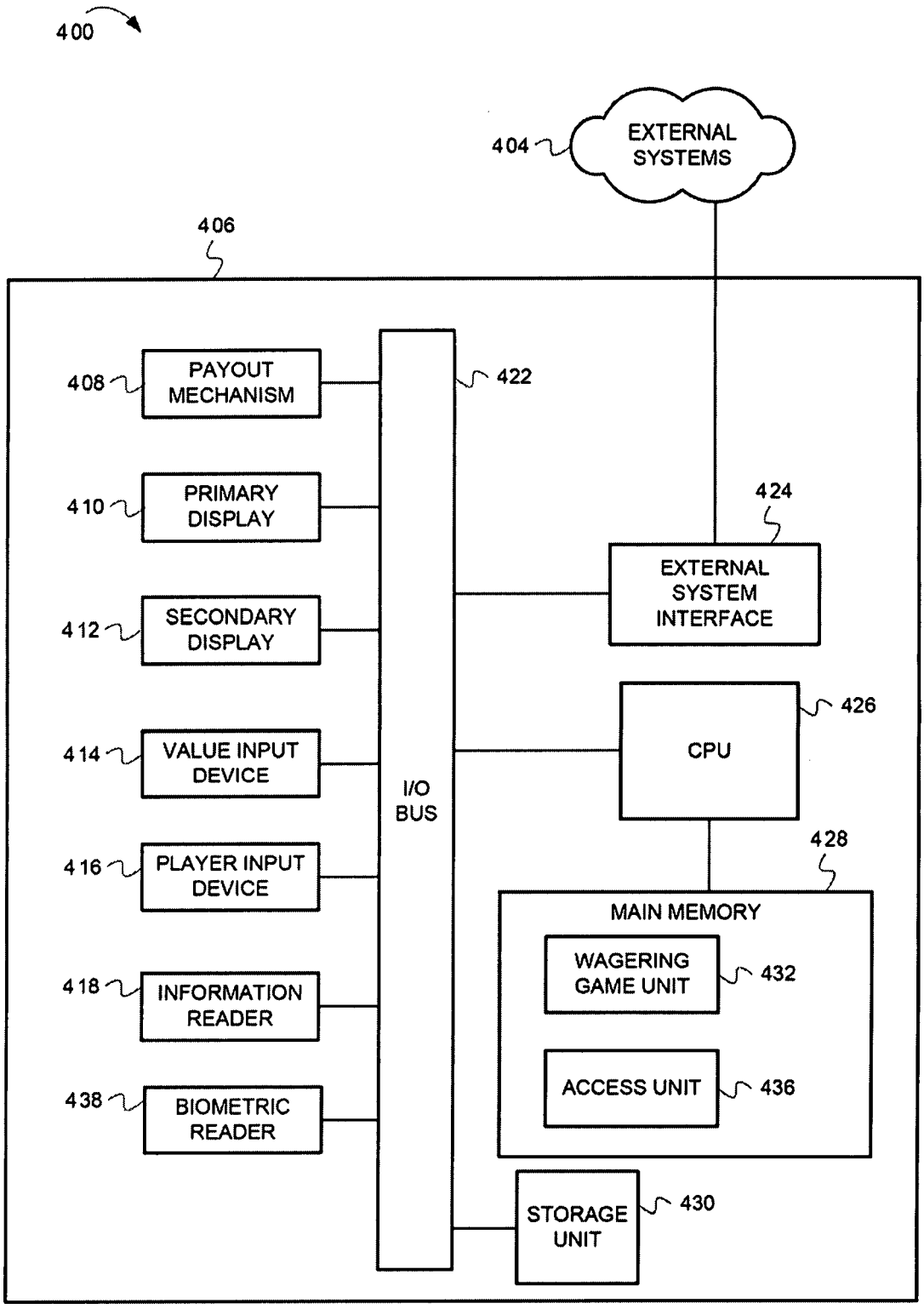
FIG. 4 is a block diagram illustrating a wagering game machine architecture, according to example embodiments of the invention.

FIG. 4 is a block diagram illustrating a wagering game machine architecture, according to example embodiments of the invention. As shown in FIG. 4, the wagering game machine 406 includes a central processing unit (CPU) 426 connected to main memory 428, which includes a wagering game unit 432 and an access unit 436. The wagering game unit 432 can present wagering games, such as video poker, video blackjack, video slots, video lottery, etc., in whole or part. The access unit 436, in some embodiments, can grant and deny access based on access credentials (e.g., usernames, passwords, biometric data, etc.) and communications with a master identifier server, casino system, manufacturer system, and/or other systems.

The CPU 426 is also connected to an input/output (I/O) bus 422, which facilitates communication between the wagering game machine's components. The I/O bus 422 is connected to a payout mechanism 408, primary display 410, secondary display 412, value input device 414, player input device 416, information reader 418, biometric reader 438, and storage unit 430. The player input device 416 can include the value input device 414 to the extent the player input device 416 is used to place wagers. The I/O bus 422 is also connected to an external system interface 424, which is connected to external systems 404 (e.g., wagering game networks).

In some embodiment, the wagering game machine 406 can include additional peripheral devices and/or more than one of each component shown in FIG. 4. For example, in one embodiment, the wagering game machine 406 can include multiple external system interfaces 424 and multiple CPUs 426. In some embodiments, any of the components can be integrated or subdivided. Additionally, in some embodiments, the components of the wagering game machine 406 can be interconnected according to any suitable interconnection architecture (e.g., directly connected, hypercube, etc.).

In some embodiments, any of the components of the wagering game machine 406 (e.g., the wagering game unit 432) can include hardware, firmware, and/or machine-readable media including instructions that, when executed by a machine, perform the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While this section presented example wagering game system architectures, the next section describes operations performed by various embodiments of the invention.

Example Operations

This section describes operations performed by embodiments of the invention. In the discussion below, the flow diagrams will be described with reference to the block diagrams presented above. In certain embodiments, the operations are performed by executing instructions residing on machine-readable media (e.g., software), while in other embodiments, the operations are performed by hardware and/or other logic (e.g., firmware). In some embodiments, the operations are performed in series, while in other embodiments, one or more of the operations can be performed in parallel.

The section presents FIGS. 5-9. This section continues with a discussion of FIGS. 5 and 6, which describe embodiments that enable users to access a plurality of wagering game systems with one set of access credentials.

Figure 5:
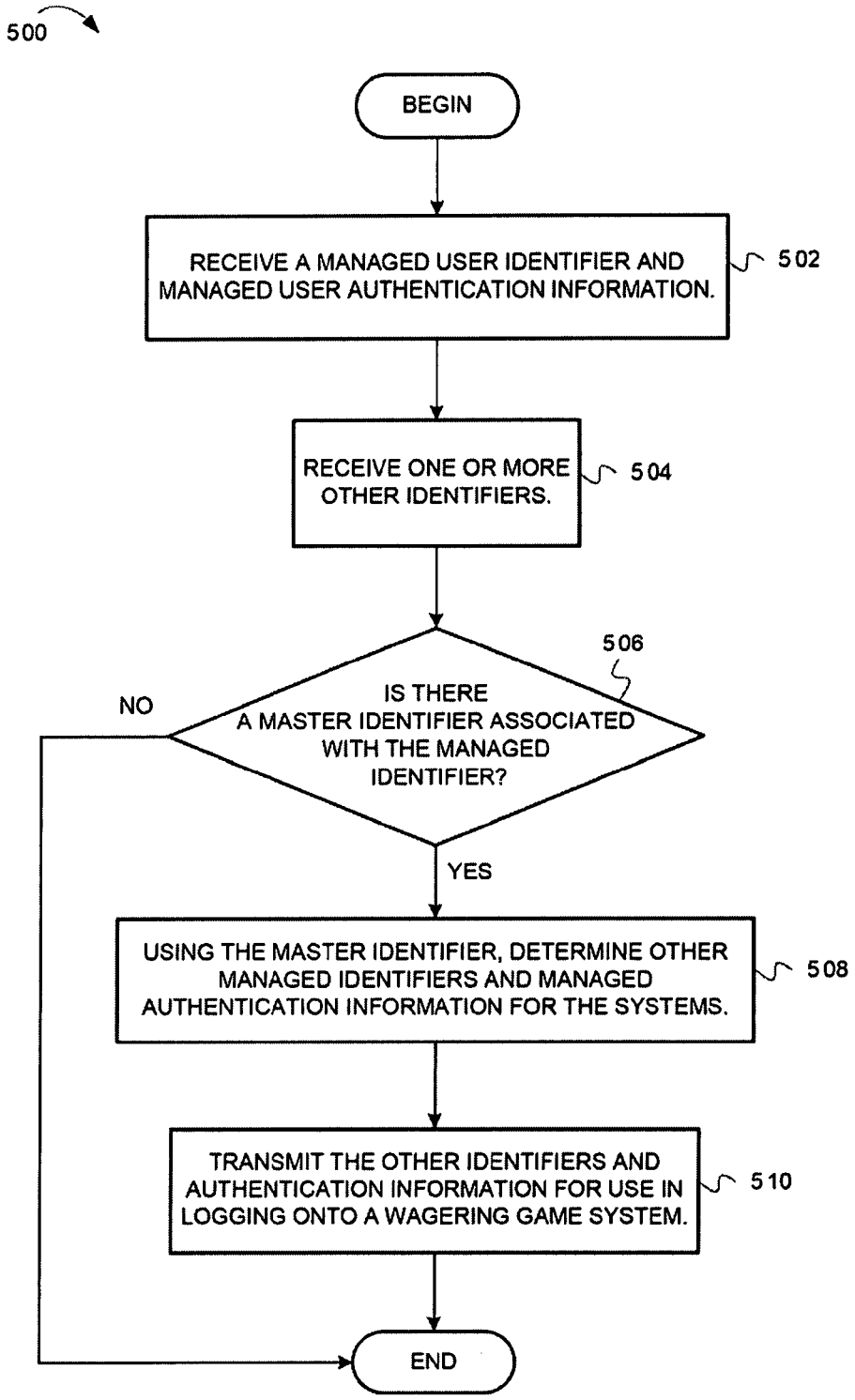
FIG. 5 is a flow diagram illustrating operations for facilitating access to a wagering game system using access credentials assigned by another wagering game system, according to example embodiments of the invention.

FIG. 5 is a flow diagram illustrating operations for facilitating access to a wagering game system using access credentials assigned by another wagering game system, according to example embodiments of the invention. The discussion of flow 500 will describe an example in which a player uses credentials assigned by Acme's Casino system to access the Jones Casino system 220. The flow begins at block 502.

At block 502, a master identifier controller's access manager 304 receives a managed identifier (e.g., username) and managed authentication information (e.g., password) from a wagering game machine 202 in Jones Casino 212. In one embodiment, Acme's casino system (not shown) assigned the managed identifier and the managed authentication information to a player as part of a registration process. The flow continues at block 504.

At block 504, the controller's access manager 304 receives one or more other identifiers from the wagering game machine 202. In some embodiments, the other identifiers indicate a casino, wagering game machine manufacturer, casino system, and/or other information. For example, the other identifiers may indicate that a particular wagering game machine 202 in the Jones Casino 212 sent the managed identifier and managed authentication information. The flow continues at block 506.

At block 506, the controller's access manager 304 determines whether there is a master identifier associated with the managed identifier. In some embodiments, the master identifier is associated with a plurality of managed identifiers. For example, in the database 308, the master identifier "JOHN_DOE" is associated with managed identifiers assigned by the Manufacturer system 222, Jones Casino 212, Acme Casino 228, and Big Fun Casino 230. If there is a master identifier associated with the managed identifier, the flow continues at block 508. Otherwise, access to the wagering game system is not success and the flow ends.

At block 508, the access manager 304 determines other managed identifiers and authentication information associated with the master identifier. For example, using the master identifier, the access manager 304 looks-up the player's managed identifier and managed authentication information assigned by Jones Casino 212. The flow continues at block 510.

At block 510, the access manager 304 transmits the other managed identifier and managed authentication information for use in logging onto a wagering game system. For example, the controller 218 transmits the player's Jones Casino access credentials for use and logging onto the Jones Casino system 220. In some embodiments, the controller 218 transmits the managed identifier and managed authentication information for use in logging into a plurality of wagering game systems.

Therefore embodiments enable players to use Acme credentials or Big Fun credentials to access the Jones Casino system 220. Similarly, players can use one set of credentials to access the manufacturer system 222, while at the same time accessing the Jones casino system 220; therefore, the player submits access credentials one time to access a plurality of wagering game systems.

Although the flow 500 was described with reference to embodiments in which an access manager receives access credentials from a wagering game machine, the flow 500 also supports other embodiments. More specifically, the flow 500 can be employed by embodiments that enable technicians and administrators to access casino systems from administrative terminals. In some embodiments, technicians can access a plurality of wagering game systems using one set of access credentials and a single login process. As a result, some embodiments enable technicians to avoid spending time logging-into multiple systems and having to remember multiple passwords and usernames.

This section continues with an alternative method for accessing different wagering game systems using one set of access credentials.

Figure 6:
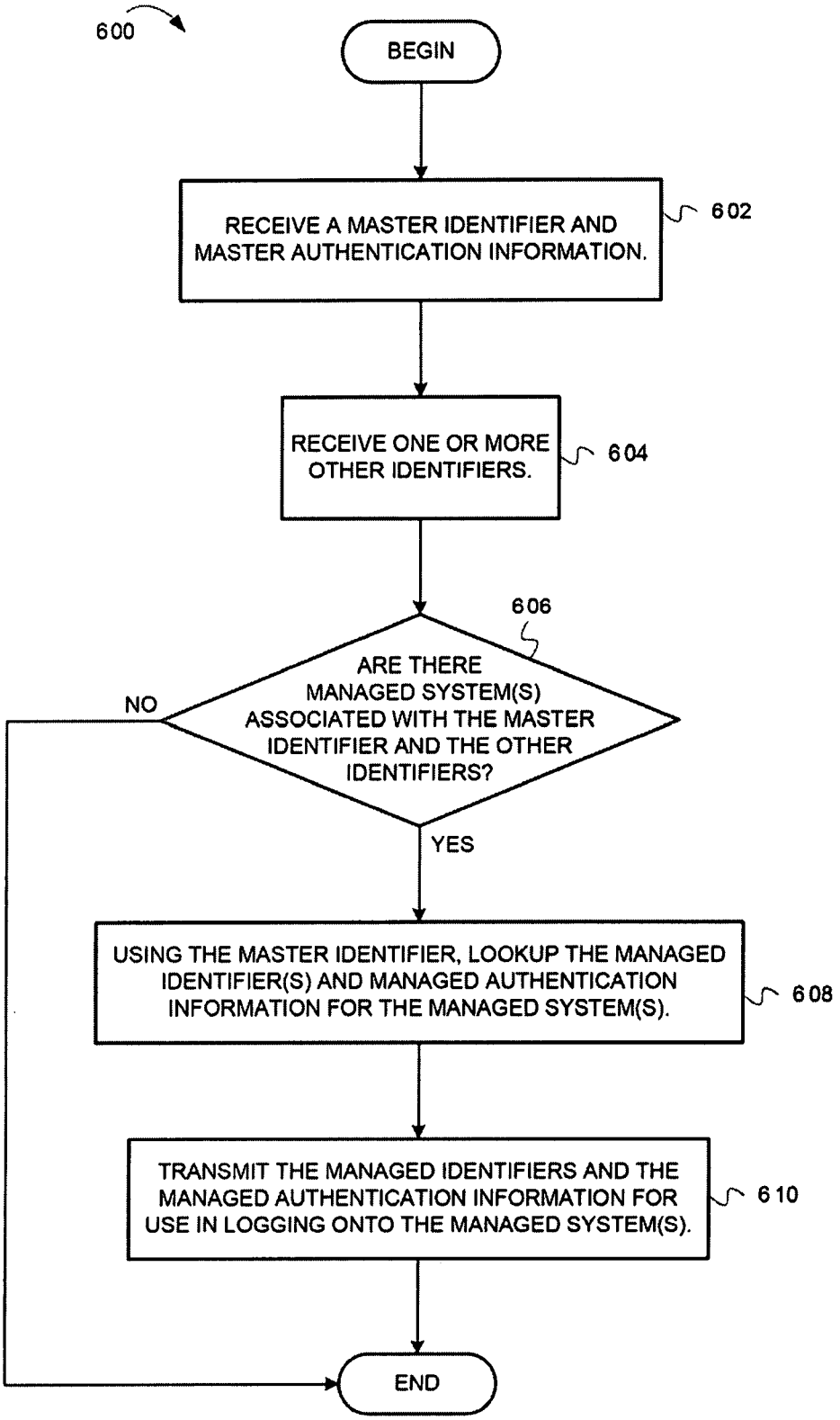
FIG. 6 is a flow diagram illustrating operations for accessing a wagering game system using master access credentials, according to example embodiments of the invention.

FIG. 6 is a flow diagram illustrating operations for accessing a wagering game system using master access credentials, according to example embodiments of the invention. The flow 600 begins at block 602.

At block 602, the master identifier controller's access manager 304 receives a master identifier and master authentication information from a wagering game machine 202 in the Jones casino 212. In some embodiments, the master identifier is associated with a plurality of managed systems that exchange access credentials and other user information with the master identifier controller 218. For example, a player's master identifier and master authentication information can be associated with wagering game systems in the Jones casino 212, Acme casino 228, Big Fun casino 230, and/or the manufacturer system 222. The flow continues at block 604.

At block 604, the access manager 304 receives one or more other identifiers from the wagering game machine 202. The other identifiers can indicate a casino, wagering game machine manufacturer, casino system, and/or other information. For example, the other identifiers can indicate that a particular wagering game machine 202 in the Jones Casino 212 sent the master identifier and master authentication information and that the particular wagering game machine was manufactured by a particular manufacturer. Furthermore, the other identifier can indicate information entered by a user. The flow continues at block 606.

At block 606, the access manager 304 determines whether there are managed systems associated with the master identifier and the other identifiers. For example, the access manager 304 determines whether the master identifier is associated with any wagering game systems in the Jones Casino 212, Acme Casino 228, Big Fun Casino 230, and/or manufacturer system 222. If there are managed systems associated with the master identifier, the flow continues at block 608. Otherwise, no wagering game systems are accessed and the flow ends.

At block 608, the access manager 304 determines a managed identifier and managed authentication information for one or more managed systems associated with the master identifier. For example, the access manager 304 determines managed identifiers and managed authentication information that can be used for accessing the Jones' casino system 220, Acme's casino system, Big Fun's casino system, and/or the manufacturer system 222. In some embodiments, the access manager 304 selects the managed identifier and managed authentication information based on the other identifiers (received at block 604). For example, if the other identifiers indicate that the master identifier was received from inside the Jones casino 212, the access manger 304 selects credentials associated with the Jones casino 212. In some embodiments, the controller 218 may select more than one set of credentials. The flow continues at block 610.

At block 610, the access manager 304 transmits the managed identifier and managed authentication information for use and logging onto a managed system. In some embodiments, the access manager 304 transmits a plurality of managed identifiers and managed authentication information for use in logging onto a plurality of managed systems. From block 610, the flow ends.

While FIGS. 5 and 6 describe operations for gaining access to wagering game systems, this section continues with a discussion of operations for managing information from different wagering game systems. This section continues with a discussion of FIG. 7.

Figure 7:
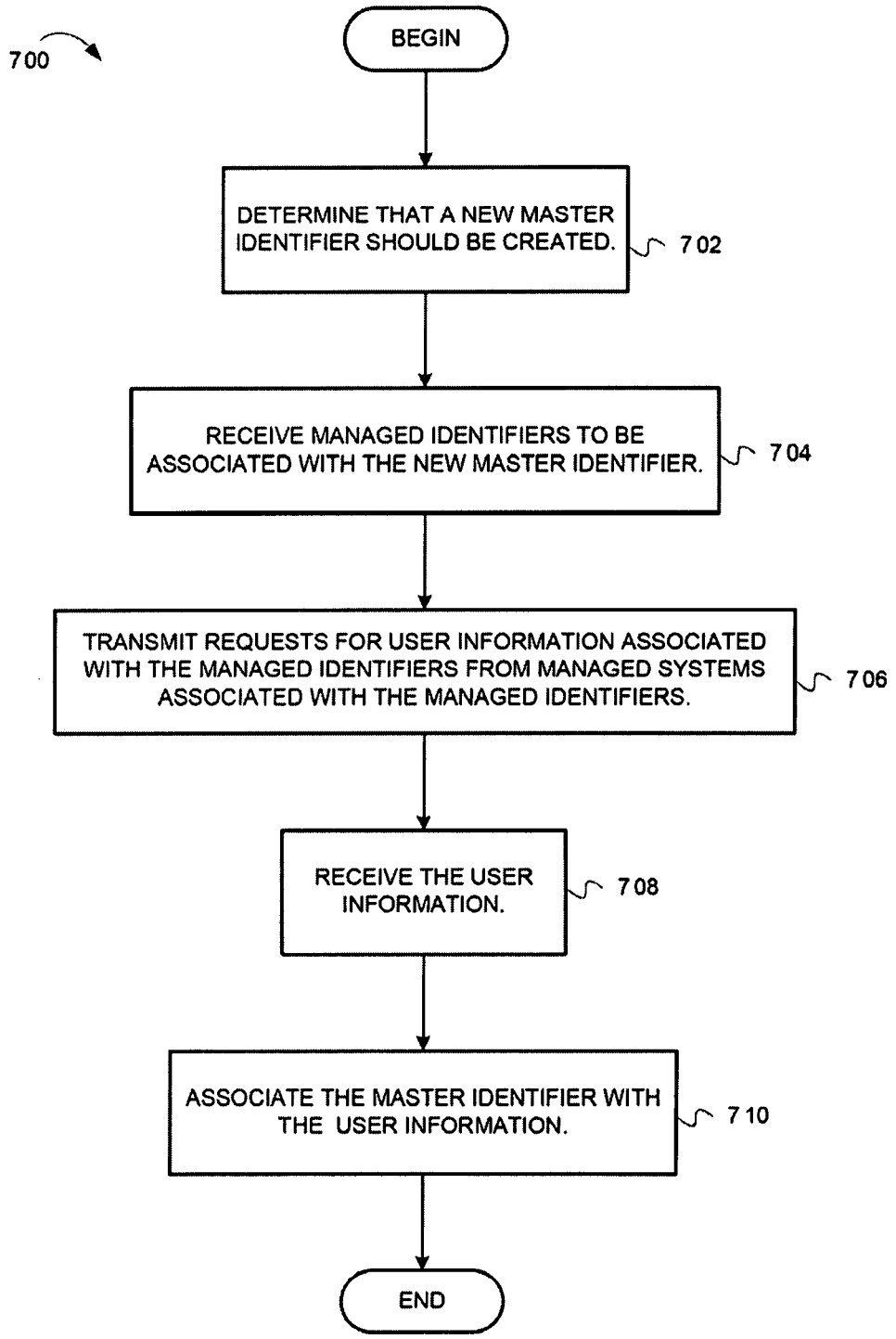
FIG. 7 is a flow diagram illustrating operations for importing information from different wagering game systems, according to example embodiments of the invention.

FIG. 7 is a flow diagram illustrating operations for importing information from different wagering game systems, according to example embodiments of the invention. The flow 700 will be described with reference to an example in which a new player signs-up for the Jones casino system 220. In some embodiments, the flow 700 enables the controller 218 to import user information from different wagering game systems, avoiding manual data entry often associated with adding new users. The flow 700 begins at block 702.

At block 702, the master identifier controller's user data manager 316 determines that a new master identifier should be created. For example, the controller 218 receives a request to create a new master identifier for a new player signing-up for the Jones casino system 220. The flow continues at block 704.

At block 704, the data manager 316 receives a managed identifier that is to be associated with the new master identifier. For example, the data manager 316 receives a username associated with the player, where the Jones casino system 220 assigned the username. In some embodiments, the data manager 316 receives a plurality of managed identifiers. The flow continues at block 706.

At block 706, the data manager 316 requests user information from the managed system, where the user information is associated with the managed identifier. For example, the data manager 316 requests the player's information (e.g., authentication information, mailing address, etc.) from the Jones casino system 220. In some embodiments, different user information can be requested from different managed systems. The flow continues at block 708.

At block 708, the data manager 316 receives the user information. The flow continues at block 710.

At block 710, the data manager 316 associates the new master identifier with the managed identifier and user information. For example, the data manager 316 stores the player's new master identifier, the player's Jones username, and other information about the player in the database 308. From block 710, the flow ends.

Figure 8:
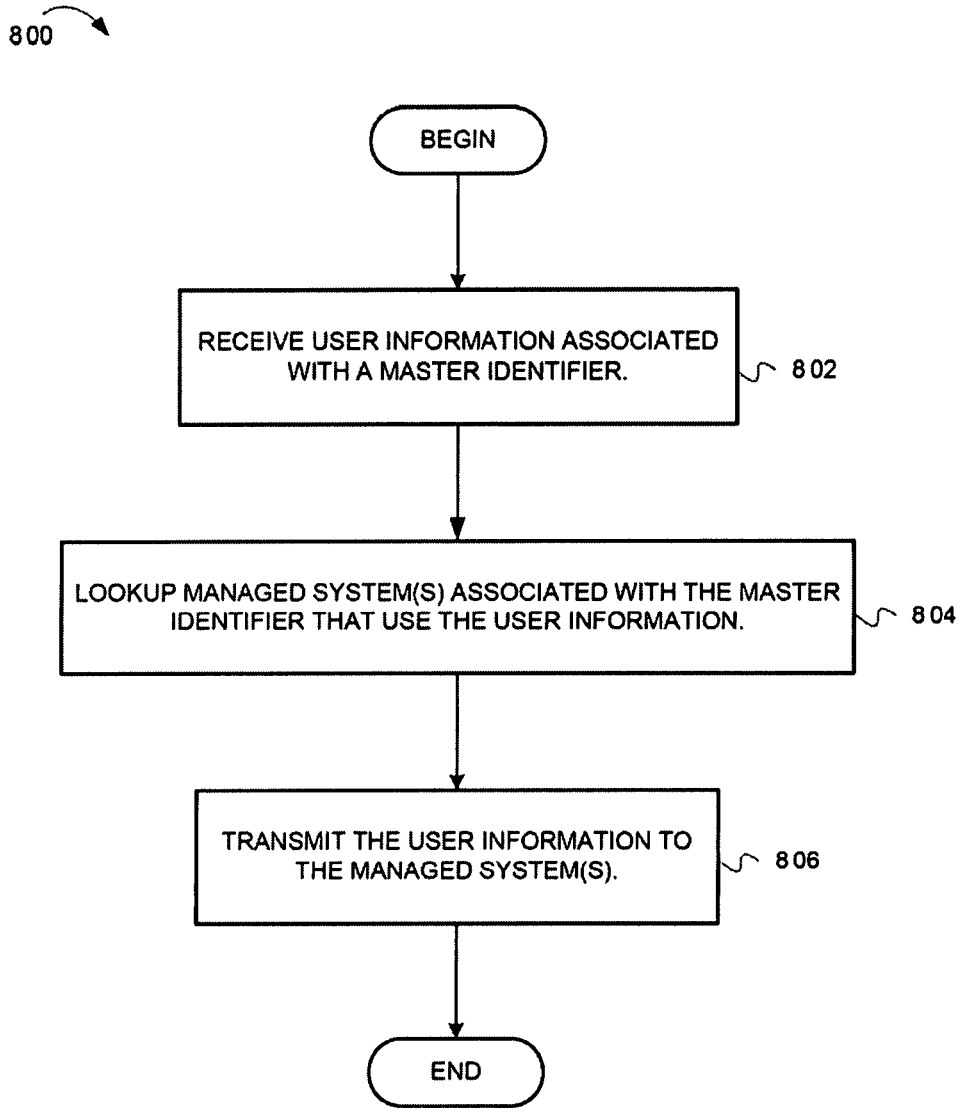
FIG. 8 is a flow diagram illustrating operations for modifying user information and updating different wagering game systems, according to example embodiments of the invention.
Figure 9:
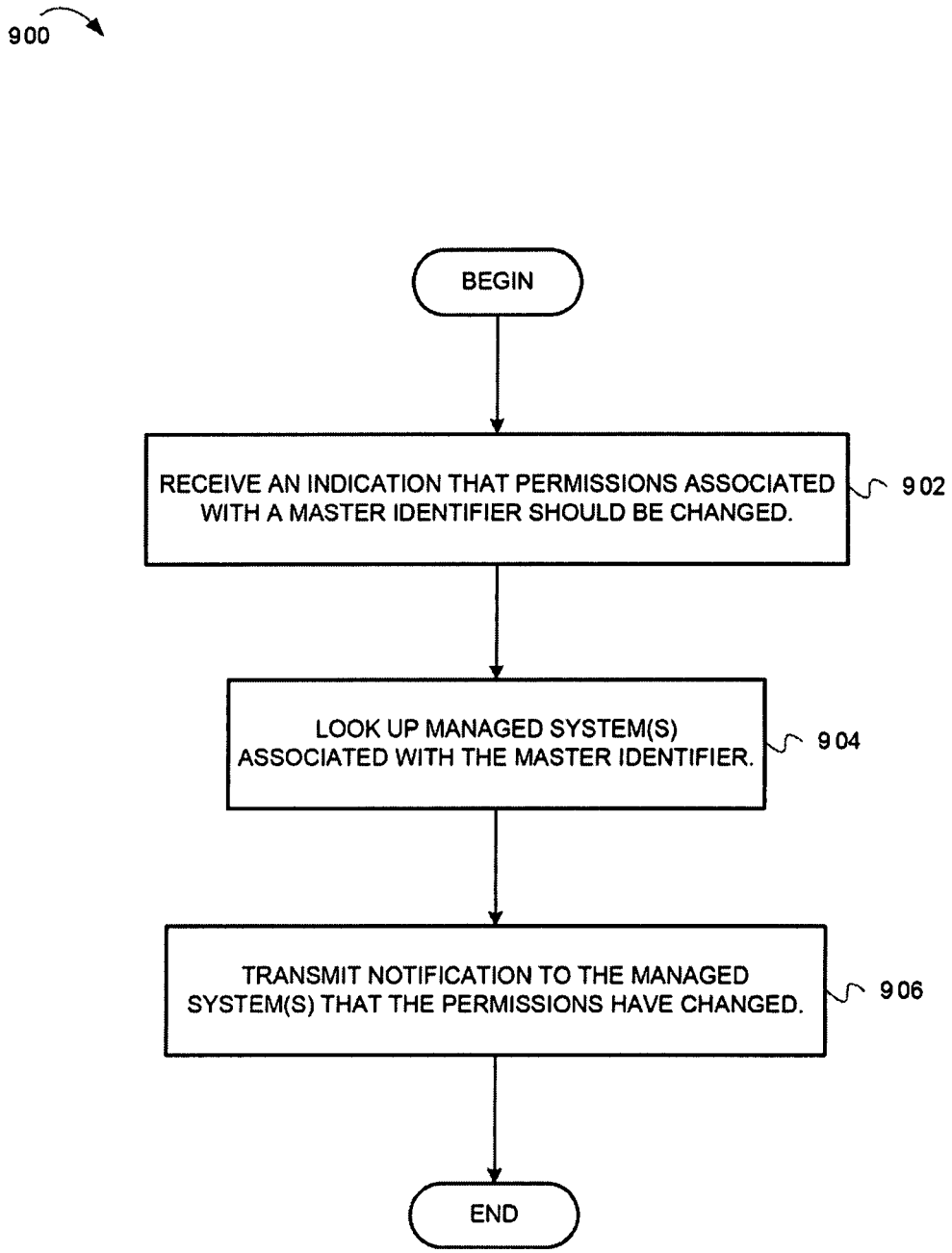
FIG. 9 is a flow diagram illustrating operations for modifying permissions associated with different wagering game systems, according to example embodiments of the invention.

This section continues with FIGS. 8 & 9, which describe additional operations for processing user information from different wagering game systems. FIGS. 8 & 9 show how a master identifier controller can synchronize data across different wagering game systems and how it can act as a central repository for user information.

FIG. 8 is a flow diagram illustrating operations for modifying user information and updating different wagering game systems, according to example embodiments of the invention. The flow 800 begins at block 802.

At block 802, the master identifier controller's data manager 316 receives user information associated with a master identifier. The data manager 316 can receive the user information from a managed wagering game system (e.g., the Jones casino system 220), back-office administrator system (not shown), wagering game machine 202, or other system. The user information can include a username, password, telephone number, address, or any other information associated with a wagering game system user. Furthermore, the user information can be received as part of a sign-up process in which a new user is given access to a managed wagering game system. The flow continues at block 804.

At block 804, the data manager 316 determines one or more managed systems that may use the user information. In some embodiments, the data manager 316 uses information in the database 308 (e.g., the managed identifier fields 310) to determine what managed systems may use the user information. The flow continues at block 806.

At block 806, the data manager 316 transmits the user information to the managed systems. From block 806, the flow ends. As a result, in some embodiments, when the controller 218 receives new user information, it sends updates to other wagering game systems.

The section continues with a discussion of operations for modifying permissions associated with different wagering game systems.

FIG. 9 is a flow diagram illustrating operations for modifying permissions associated with different wagering game systems, according to example embodiments of the invention. The flow 900 begins at block 902.

At block 902, the master identifier controller's data manager 316 receives an indication that permissions associated with a master identifier (or managed identifier) should be changed. For example, the access manager 304 informs the data manager 316 that a player's access permissions have expired (e.g., access permissions for JOHN_DOE have expired—see fields 312). The flow continues at block 904.

At block 904, the data manager 316 determines a set of managed systems associated with the master identifier. For example, the data manager 316 looks in the fields 310 of the database 308 to determine what casino systems are associated with the player. The flow continues at block 906.

At block 906, the access manager 304 notifies the managed systems that permissions have changed. For example, access manager notifies the Jones casino system 220 and other casino systems that the player's access permissions have expired.

While FIGS. 5-9 describe operations typically performed by embodiments of the master identifier controller, this section will continue with a discussion of operations typically performed by managed systems, such as a casino system 220. This section continues with a discussion of FIG. 10.

Figure 10:
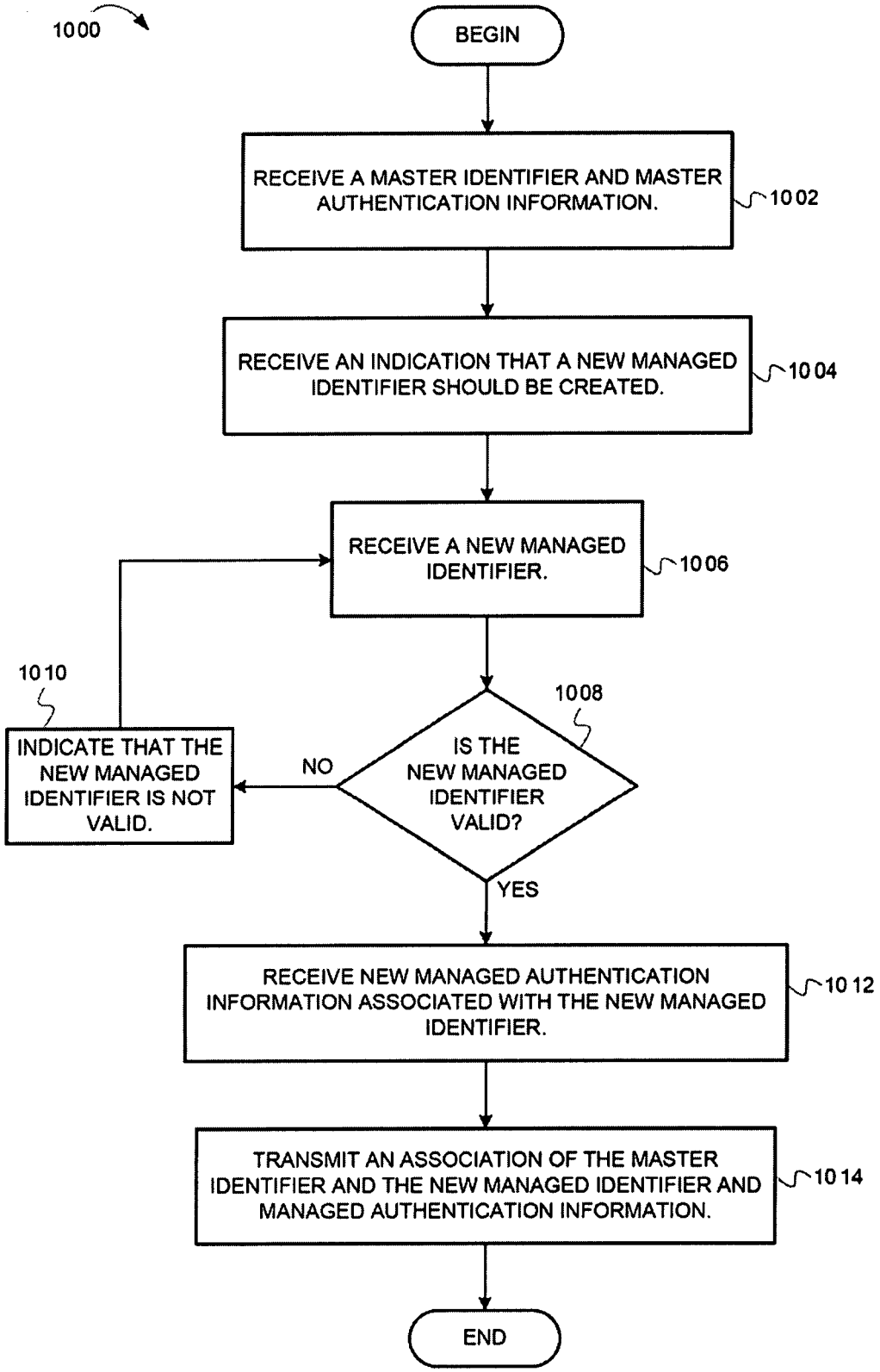
FIG. 10 is a flow diagram illustrating operations for adding a new user to a managed wagering game system, according to example embodiments of the invention.

FIG. 10 is a flow diagram illustrating operations for adding a new user to a managed wagering game system, according to example embodiments of the invention. In some embodiments, managed systems add new users through a sign-up process conducted at a wagering game machine. During the sign-up process, users can provide existing credentials to acquire new credentials for accessing the managed systems. The flow 1000 begins at block 1002.

At block 1002, the casino system 220 receives a user identifier and user authentication information from a wagering game machine 202. The wagering game machine 202 may have received the user identifier and user authentication information from a user, as part of a login process. In some embodiments, the user can provide the user identifier and user authentication information with a magnetic card or other suitable device. The user identifier can be a master identifier or a managed identifier associated with a managed wagering system. The flow continues at block 1004.

At block 1004, the casino system 220 receives an indication that a new managed identifier should be created. For example, the user requests to join a players' club on the casino system 220. The flow continues at block 1006.

At block 1006, the casino system 220 receives a new managed identifier. For example, as part of the sign-up process, the wagering game machine 202 receives a new username (input by a user) and transmits it to the casino system 220. Alternatively, the casino system 220 generates the new managed identifier; in such a case, block 1008 is skipped and the flow continues at block 1012. The flow continues at block 1008.

At block 1008, the casino system 220 determines whether the new managed identifier is valid. For example, the casino system determines whether the new username is valid (e.g., does not exceed a specified length). If the new managed identifier is not valid the flow continues at block 1010. Otherwise, the flow continues at block 1012.

At block 1010, the casino system 220 informs the wagering game machine 220 that the new managed identifier is not valid. The flow continues at block 1006.

At block 1012, the casino system 220 receives new managed authentication information associated with the managed identifier. For example, the casino system 220 receives a new password or biometric information from the wagering game machine 202. The casino system 220 can also determine whether the new managed authentication is valid. The flow continues at block 1014.

At block 1014, the casino system 220 informs the user identifier controller 218 about an association between the user identifier and the new managed identifier (e.g., new username) and the managed authentication information (e.g., new password). The controller 218 can store the new username and password in the table 308—in fields associated with the user identifier. From block 1014, the flow ends.

Example Wagering Game Machines

Figure 11:
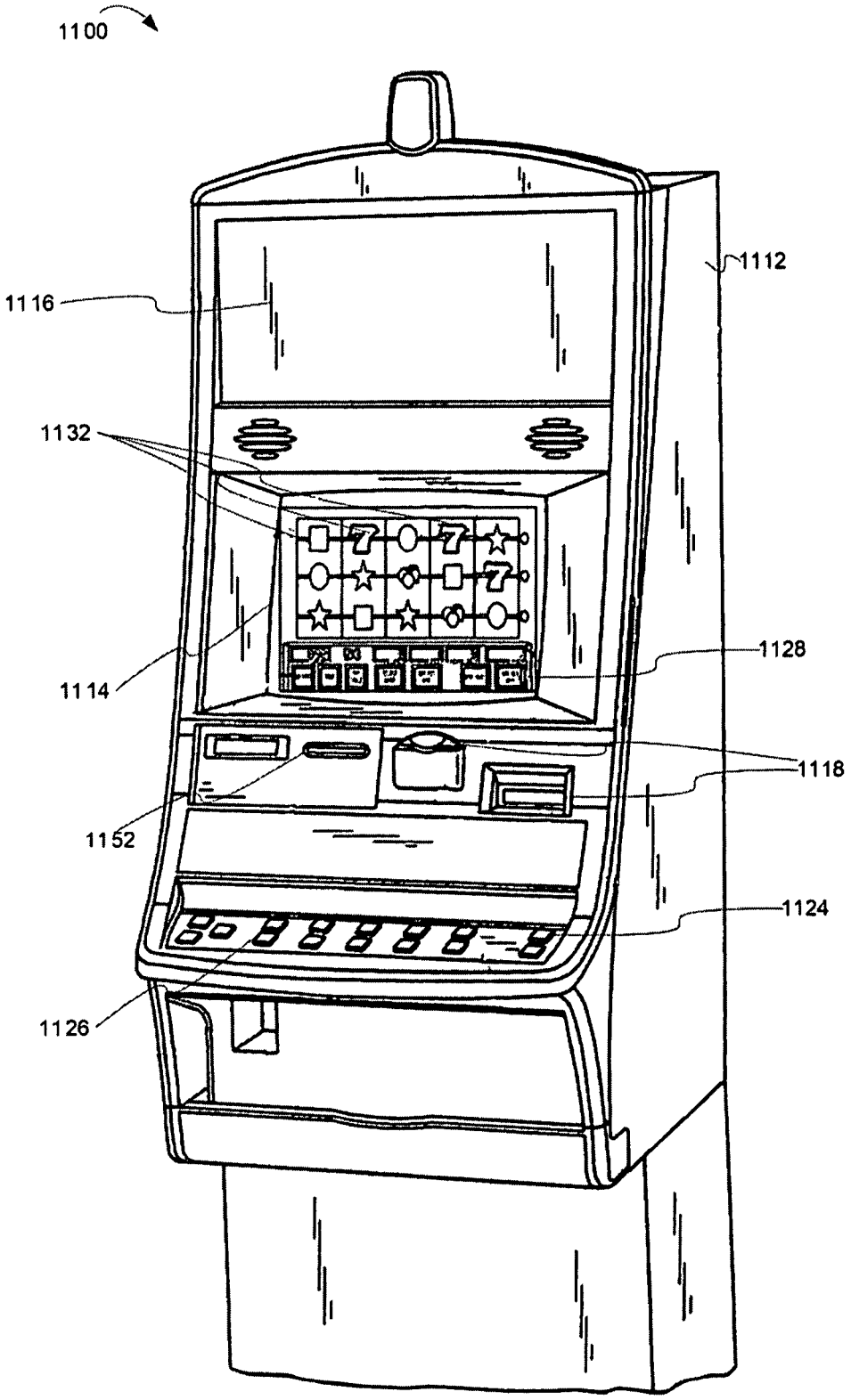
FIG. 11 is a perspective view of a wagering game machine, according to example embodiments of the invention.

FIG. 11 is a perspective view of a wagering game machine, according to example embodiments of the invention. Referring to FIG. 11, a wagering game machine 1100 is used in gaming establishments, such as casinos. According to embodiments, the wagering game machine 1100 can be any type of wagering game machine and can have varying structures and methods of operation. For example, the wagering game machine 1100 can be an electromechanical wagering game machine configured to play mechanical slots, or it can be an electronic wagering game machine configured to play video casino games, such as blackjack, slots, keno, poker, blackjack, roulette, etc.

The wagering game machine 1100 comprises a housing 1112 and includes input devices, including value input devices 1118 and a player input device 1124. For output, the wagering game machine 1100 includes a primary display 1114 for displaying information about a basic wagering game. The primary display 1114 can also display information about a bonus wagering game and a progressive wagering game. The wagering game machine 1100 also includes a secondary display 1116 for displaying wagering game events, wagering game outcomes, and/or signage information. While some components of the wagering game machine 1100 are described herein, numerous other elements can exist and can be used in any number or combination to create varying forms of the wagering game machine 1100.

The value input devices 1118 can take any suitable form and can be located on the front of the housing 1112. The value input devices 1118 can receive currency and/or credits inserted by a player. The value input devices 1118 can include coin acceptors for receiving coin currency and bill acceptors for receiving paper currency. Furthermore, the value input devices 1118 can include ticket readers or barcode scanners for reading information stored on vouchers, cards, or other tangible portable storage devices. The vouchers or cards can authorize access to central accounts, which can transfer money to the wagering game machine 1100.

The player input device 1124 comprises a plurality of push buttons on a button panel 1126 for operating the wagering game machine 1100. In addition, or alternatively, the player input device 1124 can comprise a touch screen 1128 mounted over the primary display 1114 and/or secondary display 1116.

The various components of the wagering game machine 1100 can be connected directly to, or contained within, the housing 1112. Alternatively, some of the wagering game machine's components can be located outside of the housing 1112, while being communicatively coupled with the wagering game machine 1100 using any suitable wired or wireless communication technology.

The operation of the basic wagering game can be displayed to the player on the primary display 1114. The primary display 1114 can also display a bonus game associated with the basic wagering game. The primary display 1114 can include a cathode ray tube (CRT), a high resolution liquid crystal display (LCD), a plasma display, light emitting diodes (LEDs), or any other type of display suitable for use in the wagering game machine 1100. Alternatively, the primary display 1114 can include a number of mechanical reels to display the outcome. In FIG. 11, the wagering game machine 1100 is an "upright" version in which the primary display 1114 is oriented vertically relative to the player. Alternatively, the wagering game machine can be a "slant-top" version in which the primary display 1114 is slanted at about a thirty-degree angle toward the player of the wagering game machine 1100. In yet another embodiment, the wagering game machine 1100 can exhibit any suitable form factor, such as a free standing model, bartop model, mobile handheld model, or workstation console model.

A player begins playing a basic wagering game by making a wager via the value input device 1118. The player can initiate play by using the player input device's buttons or touch screen 1128. The basic game can include arranging a plurality of symbols along a payline 1132, which indicates one or more outcomes of the basic game. Such outcomes can be randomly selected in response to player input. At least one of the outcomes, which can include any variation or combination of symbols, can trigger a bonus game.

In some embodiments, the wagering game machine 1100 can also include an information reader 1152, which can include a card reader, ticket reader, bar code scanner, RFID transceiver, or computer readable storage medium interface. In some embodiments, the information reader 1152 can be used to award complimentary services, restore game assets, track player habits, etc.

General

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A wagering game network comprising:

a first wagering game system configured to assign to a user first access credentials for accessing the first wagering game system, wherein the first wagering game system includes first wagering game machines each including a first electronic value input device configured to detect a first physical item associated with a first monetary value that establishes a first credit balance;

a first wagering game unit configured to conduct first wagering games and determine first wagers covered by the first credit balance; and a first payout mechanism configured to make a first payout of the first credit balance;

a second wagering game system configured to assign to the user second access credentials for accessing the second wagering game system, wherein the second wagering game system includes second wagering game machines each includes an access unit configured to receive the first access credentials, provide the first access credentials to a master identifier controller, and receive from the master identifier controller information for granting access to the second wagering game system based on the first access credentials;

a second electronic value input device configured to detect a second physical item associated with a second monetary value that establishes a second credit balance;

a second wagering game unit configured to conduct second wagering games and determine second wagers covered by the second credit balance;

a second payout mechanism configured to make a second payout of the second credit balance;

the master identifier controller configured to receive and store the first and second access credentials, to receive requests to access the second wagering game system based on the first access credentials, and to transmit the information for granting access to the second wagering game system, based on the second access credentials.

2. The wagering game network of claim 1, wherein the first and second access credentials include one or more selected from the group comprising username, password, and biometric information.

3. The wagering game network of claim 1, wherein the user is selected from the group comprising a wagering game player, a system administrator, and a wagering game machine technician.

4. The wagering game network of claim 1, wherein the first and second wagering game systems track wagers made by the user.

5. The wagering game network of claim 1, wherein the first and second wagering game systems track repairs made by the user.

6. The wagering game network of claim 1, wherein the master identifier controller is further configured to receive requests to access the first wagering game system based on the first access credentials, and to facilitate access the first wagering game system based on the first access credentials.

7. The wagering game network of claim 1, wherein the master identifier controller is further configured to receive the requests to access the first wagering game system from ones of the first wagering game machines.

8. A machine-readable memory device storing instructions that are executable by a machine, the instructions for updating user information across different wagering game systems that include wagering game machines, wherein the wagering game systems are controlled by different entities, the instructions comprising:

instructions to receive, by a first wagering game machine of a first wagering game system, a second access credential associated with a player and, assigned by a second wagering game system;

instructions to transmit, over a communications network, the second access credential to a master identifier controller;

instructions to receive, by the master identifier controller, the second access credential;

instructions to identify, by the master identifier controller based on the second access credential, a first access credential that enables the player to access the first wagering game system via the first wagering game machine;

instructions to transmit, over the communications network, the first access credential to the first wagering game machine;

instructions to enable, by an access unit of the first wagering game machine, the player to access the first wagering game system based on the first access credential;

instructions to detect, via an electronic input device of the first wagering game machine, a physical item associated with a monetary value that establishes a credit balance;

instructions to conduct, via a wagering game unit of the first wagering game machine, a wagering game involving wagers covered by the credit balance; and instructions to pay the credit balance via a payout mechanism of the first wagering game machine.

9. The machine-readable memory device of claim 8, the instructions further comprising:

instructions to store the first and second access credentials in a database, wherein the first and second access credentials are stored in association with an identifier associated with the player.

10. The machine-readable memory device of claim 8, wherein the first and second access credentials include one or more of username, password, telephone number, address, credit limit, game play preferences, or payment information.

11. The machine-readable memory device of claim 8, wherein the first access credential is not recognized by the second wagering game system.

12. The machine-readable memory device of claim 8, the instructions further comprising:

instructions to determine other information associated with the player; and instructions to transmit the other information to the first wagering game system.

13. A computer-implemented method for facilitating access to a plurality of wagering game systems, wherein each of the wagering game systems assigns a different player identifier for use in player log-in processes, the method comprising:

receiving, over a network from a wagering game machine, a first player identifier as part of a player log-in process initiated at the wagering game machine, wherein the first player identifier was assigned by a first wagering game system;

receiving, over the network from the wagering game machine, a system identifier indicating that the wagering game machine is part of a second wagering game system;

processing, by a master identifier controller, the first player identifier and the system identifier to identify the second wagering game system;

determining, by the master identifier controller, a second player identifier associated with the first player identifier and with the second wagering game system; and transmitting the second player identifier to the wagering game machine for use in granting access to the second wagering game system;

receiving, by the wagering game machine, the second player identifier;

enabling, by the wagering game machine, a player to log-in to the first wagering game system based on the second player identifier;

detecting, via an electronic input device of the wagering game machine, a physical item associated with a monetary value that establishes a credit balance;

conducting, via a wagering game unit of the wagering game machine, a wagering game involving wagers covered by the credit balance; and paying the credit balance via a payout mechanism of the wagering game machine.

14. The method of claim 13, wherein the first player identifier is received as a result of one or more actions selected from the group comprising receiving a player card at the remote wagering game machine, and receiving biometric information at the remote wagering game machine.

15. The method of claim 13, wherein the system identifier indicates one or more of the group comprising a wagering game machine manufacturer and wagering game system membership information.

16. The method of claim 13 further comprising:

transmitting the second player identifier to a component of the third wagering game system.

17. The method of claim 13, wherein the second player identifier is associated with one or more of the group comprising casino patrons, casino administrators, service technicians, wagering game administrators, and wagering game players.

18. The method of claim 13, wherein the first wagering game system is selected from the group comprising a manufacturer player tracking system, a casino player tracking system, and a casino configuration system.

* * * * *